US005405286A

United States Patent [19]

Welsch

[11] Patent Number: 5,405,286

[45] Date of Patent: * Apr. 11, 1995

[54] FLEXIBLE SANDING/DEBURRING HEAD

[75] Inventor: Walter N. Welsch, Tonawanda, N.Y.

[73] Assignee: Dynabrade, Inc., Clarence, N.Y.

[ * ] Notice: The portion of the term of this patent subsequent to Jun. 30, 2009 has been disclaimed.

[21] Appl. No.: 933,069

[22] Filed: Aug. 21, 1992

[51] Int. Cl.[6] ..... B24D 11/00

[52] U.S. Cl. ..... 451/527; 451/358; 451/548; 451/533

[58] Field of Search ..... 51/394, 401, 395, 397, 51/405, 406, 207, 209 R, 330, 331, 376, 377, 170 PT, 170 R, 170 T

[56] References Cited

U.S. PATENT DOCUMENTS

| | | | |
|---|---|---|---|
| 1,308,093 | 7/1919 | Merritt, Jr. | 51/376 |
| 2,146,548 | 2/1939 | Mitschang et al. | 51/193 |
| 2,291,524 | 7/1942 | Best et al. | 300/21 |
| 2,749,681 | 6/1956 | Reidenbach | 51/195 |
| 3,729,872 | 5/1973 | Hall, Jr. | 51/401 |
| 5,125,192 | 6/1992 | Welsch | 51/401 |
| 5,142,829 | 9/1992 | Germain | 51/378 |

FOREIGN PATENT DOCUMENTS

| | | |
|---|---|---|
| 1494215 | 7/1966 | France . |
| 2240080 | 3/1975 | France . |
| 2539068 | 7/1984 | France . |
| 8426853 | 1/1986 | Germany . |

*Primary Examiner*—Robert A. Rose
*Attorney, Agent, or Firm*—Bean, Kauffman & Spencer

[57] ABSTRACT

A flexible sanding/deburring head adapted for driven rotation by a power tool is formed from a plurality of juxtaposed thin sheets of flexible abrasive material individually die cut to define a connecting portion having a mounting opening disposed centrally thereof and at least three projections connected to the connecting portion to extend generally radially of the mounting opening, wherein the projections are uniformly spaced annularly of the mounting opening and bound uniformly sized cut-out areas opening radially of the mounting opening and each projection is divided into parallel fingers having relatively inner ends connected to the connecting portion and relatively outer ends arranged to lie generally along arcs of a circle whose center is coincident with the center of the mounting opening. The projections are skip-cut to define the fingers.

25 Claims, 4 Drawing Sheets

FLEXIBLE SANDING/DEBURRING HEAD

BACKGROUND OF THE INVENTION

Sanding/deburring heads formed by joining together a plurality of skip-cut strips of flexible abrasive sheet material in a fan shaped orientation are well known and commonly referred to as "Star" heads. Star heads are widely used to perform wood sanding and metal deburring operations depending on the rotational speed at which the heads are driven and/or the composition of the sheet materials from which the skip-cut strips are formed.

Star heads are typically formed by first providing parallel lengthwise extending skip-cuts in an elongated strip of suitable abrasive material, such as may be supplied by a roll, and then transversely severing the elongated strip to provide individual strips whose lengths correspond to the diameter of a head to be formed. As an incident to the forming operation, the individual strips are each provided with a centrally located mounting opening. After the individual strips are formed, they are assembled on a mandrel with their mounting openings disposed in alignment and to lie in a fan-like orientation, wherein the edges of adjacent strips overlie one another in a direction extending annularly of the mounting openings until a sufficient number of strips are assembled to provide a disc-shaped, plan view configuration. Thereafter the assembled strips are joined by a grommet bounding their mounting openings.

Star heads suffer the drawbacks of their being relatively expensive to manufacture and relatively stiff, as compared to the abrasive material from which they are formed. Moreover, the degree of stiffness of Star heads increases as their diameters decrease, due to the wearing away of their peripheries during use, and as a result, Star heads became unsuitable for sanding contoured surfaces after relatively little use.

SUMMARY OF THE INVENTION

The present invention is directed toward an improved head for performing sanding and/or deburring operations, and more particularly towards a flexible sanding/deburring head possessing advantages over present Star heads.

In accordance with the present invention, a flexible sanding/deburring head is formed from one or more head units, which comprise a plurality of juxtaposed thin sheets of flexible abrasive material individually die cut to define a connecting portion having a centrally located mounting opening and three or more projections connected to the connecting portion to extend generally radially of the mounting opening. The projections are preferably uniformly spaced apart annularly of the mounting opening and bound uniformly sized, generally V or wedge-shaped areas. The areas are preferably cut-out and open radially outwardly of the connecting portion. Each projection is divided into parallel fingers having inner ends connected to the connecting portion and outer ends arranged to lie along arcs of a circle whose center is coincident with the center of the mounting opening. The projections and areas of adjacent sheets are preferably disposed in alignment.

BRIEF DESCRIPTION OF THE DRAWINGS

The nature and mode of operation of the present invention will now be more fully described in the following detailed description taken with the accompanying drawings wherein.

DETAILED DESCRIPTION

Figures 1, 2, 3:
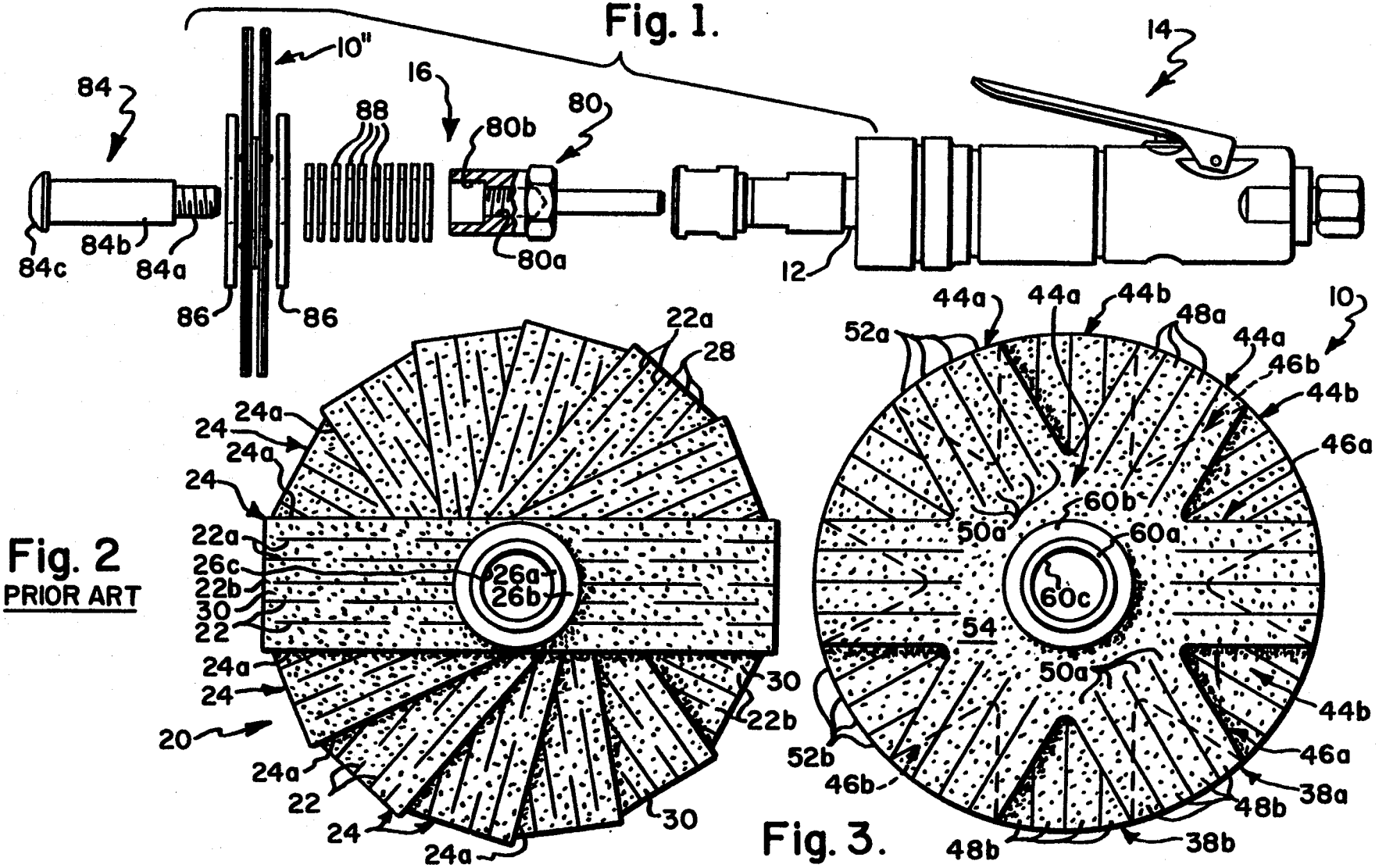
Fig. 2 PRIOR ART
FIG. 1 is an exploded view illustrating one mode of mounting a sanding/deburring head of the present invention on a rotor power tool.
FIG. 2 is a plan view of a Star head.
FIG. 3 is a plan view of a sanding/deburring head formed in accordance with the present invention.

Reference is first made to FIG. 1, wherein a flexible sanding/deburring head formed in accordance with one form of the present invention is shown for purposes of illustration as being adapted to be mounted on a rotatable output or drive shaft 12 of a conventional, hand manipulated, pneumatically driven tool 14 by an adjustable mounting assembly 16. The term sanding/deburring is intended to designate a head formed of flexible abrasive sheet material and capable of performing a wide range of abrading operations depending upon the characteristics of the sheet material employed in its fabrication and the rotation speed at which it is driven.

In FIG. 2 there is shown a well known prior type of sanding/deburring head designated as 20 and known as a "Star" head. Star head 20 is typically formed by transversely severing an elongated strip of flexible abrasive material having parallel skip-cuts 22 extending lengthwise thereof to provide a plurality of individual strips 24 whose lengths correspond to the diameter of the Star head to be formed. As an incident to forming strips 24, each is formed with a mounting opening, not shown, which is centered lengthwise and widthwise thereof. Star head 20 is assembled by laying-up a first group of strips 24 one at a time with their mounting openings disposed in alignment, their abrasive surfaces facing in a common direction and their adjacent lengthwise extending edges **24*a* disposed to lie in an overlapping relationship, until a sufficient number of strips has been laid up to create the generally disc-shaped, plan view configuration depicted in FIG. 2. A second group of like numbered and arranged strips 24 is then laid-up on the first group, but with the abrasive surfaces of the second group facing away from the abrasive surfaces of the first group. Thereafter, the stack of strips formed by the first and second groups of strips 24 is permanently assembled by a metal grommet defined by ring parts 26*a* and 26*b*, wherein ring part 26*a* extends through the mounting openings of the strips and is mechanically joined to ring part 26*b*. Typically, a plurality of individual assemblies or head units of the type described are permanently assembled together in an axially aligned and axial end-to-axial end abutting relationship to provide a Star head of desired axial length by attaching, as by adhesive, the individual assemblies to a common mounting or drive shaft, not shown, which extends axially through the central opening 26*c*** of their respective grommets.

In a typical commercial 4 inch diameter Star head of the prior type described above, strips 24 ,each have lengths of 4 inches and widths of about 1 1/16 inch, and the first and second groups of strips have 7 strips each, such that each individual assembly or head unit includes 14 individual strips of abrasive material joined together by a common grommet.

Figure 4:
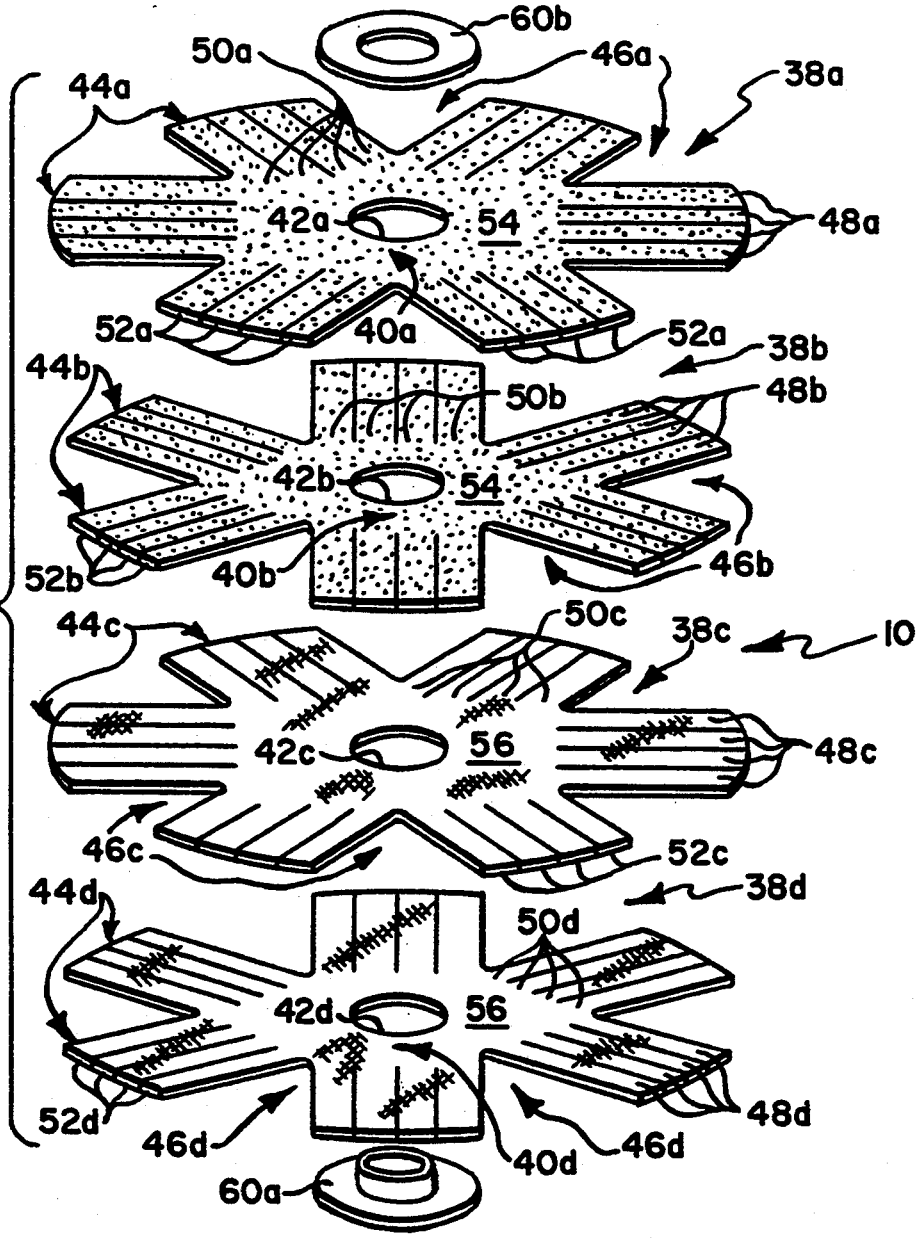
FIG. 4 is an exploded, perspective view of the head shown in FIG. 3.

A flexible sanding/deburring head formed in accordance with a first form of the present invention is generally designated as 10 and shown in FIGS. 3 and 4 as being defined by four sheets of a suitable, relatively thin, flexible abrasive material 38*a*–38*d*, which are shaped to define connecting portions 40*a*–40*d* having centrally located mounting openings 42*a*–42*d* and a plurality of projections 44*a*–44*d* connected to their associated connecting portions and arranged to extend generally radially with respect to their associated mounting openings in a uniform annularly spaced relationship. Adjacent projections 44*a*–44*d* cooperate to bound essentially uniformly sized areas 46*a*–46*d*, which are preferably cut-out to remove abrasive material therefrom. Projections 44*a*–44*d* are divided into a plurality of parallel fingers 48*a*–48*b*, which are unconnected to each other throughout their lengths and have their relatively inner ends 50*a*–50*d* connected to their associated connecting portions 40*a*–40*d* and their relatively outer ends 52*a*–52*d* arranged to lie essentially along arcs of a circle whose center is coincident with the center of their associated mounting openings 42*a*–42*d*.

As for the case of prior Star heads, in the present wheel, sheets 38*a*–38*d* would normally be cut from suitable, abrasive sheet stock material typically having an abrasive surface 54 and a relatively non-abrasive surface 56 defined by a woven or other suitable carrier material to which abrasive material is bonded to create the abrasive surface. Sheets 38*a*–38*d* are shown in FIG. 4 as being arranged in first and second groups of adjacent sheets, e.g. sheets 38*a*, 38*b* and sheets 38*c*, 38*d*, wherein the abrasive surfaces of adjacent sheets of a first group face in a direction away from the abrasive surfaces of adjacent sheets of the second group. Thus, abrasive surfaces of sheets 38*a* and 38*d* are intended to define the axially opposite ends of head 10 with the abrasive surfaces of sheets 38*b* and 38*c* being arranged in a facing relationship to the relatively non-abrasive surfaces of sheets 38*a* and 38*d*, respectively, and with the non-abrasive surfaces of sheets 38*b* and 38*c* being arranged in a facing relationship. The number of sheets in each group may be varied, as desired, but a head having two sheets in each group is preferred.

In the embodiment of FIGS. 3 and 4, sheets 38*a*–38*d* are shown as being joined together to define an assembled head unit by a conventional metal grommet defined by ring parts 60*a* and 60*b*, wherein ring part 60*a* extends through mounting openings 42*a*–42*d* and is mechanically joined to ring part 60*b* for purposes of clamping sheets 38*a*–38*d* in juxtaposition or in a stacked relationship. The means employed to assemble sheets 38*a*–38*d* in stacked relation is in no way limiting on the present invention.

When sheets 38*a*–38*d* are assembled, projections 44*a*–44*d* and areas 46*a*–46*d* of adjacent sheets are arranged to lie in alignment. Thus, projections 44*a* are aligned with areas 46*b*, which are aligned with projections 44*c*, which are in turn aligned with areas 46*d*. Preferably, the widths of projections 44*a*–44*d*, as measured transversely of fingers 48*a*–48*b*, are essentially equal to or exceed the widths of areas 46*a*–46*d*, as measured between adjacent projections at the outer ends 52*a*–52*d* of their respective fingers, whereby the projections of the sheets bridge across the areas of adjacent sheets, as best shown in FIG. 3.

FIGS. 3 and 4 depict a proposed 4 inch diameter head defined by 4 sheets each having six uniformly sized projections and six uniformly sized cut-out areas of generally V-shaped or wedge-shaped design. For this size head, the lengths of fingers 48*a*–48*d* would equal or slightly exceed the widths of projections 44*a*–44*d*, and the number of fingers formed from each projection would typically range between 4 and 7 depending upon the abrading operation to be performed.

Figure 6:
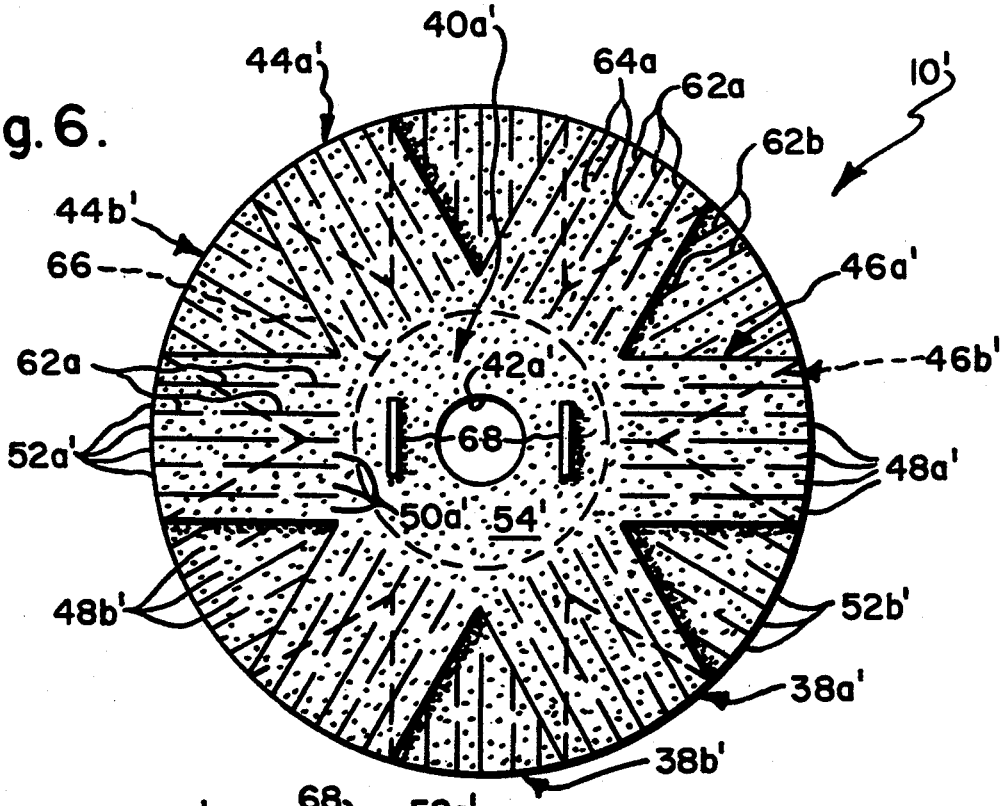
FIG. 6 is a plan view of a further sanding/deburring head construction employing two abrasive sheets.
Figure 7:
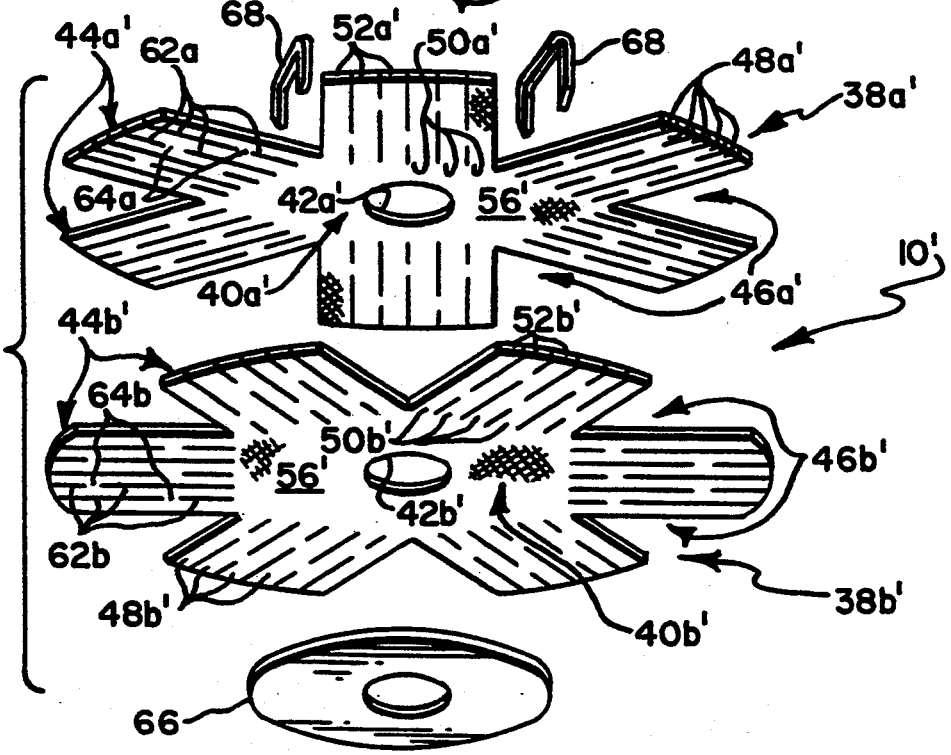
FIG. 7 is an exploded, perspective view of the head shown in FIG. 6.

FIGS. 6 and 7 show a further and presently preferred form of head 10' having a diameter of, for example, four inches, wherein elements thereof which correspond to those of head 10 are designated by like primed numerals. More specifically, head 10' is formed from two sheets 38*a'* and 38*b'* cut from suitable abrasive sheet stock material having an abrasive surface 54' and a relatively non-abrasive surface 56', wherein the abrasive surfaces of such sheets are preferably arranged to face in a like or common direction upon assembly of the head.

Sheets 38*a'* and 38*b'* are cut to define connecting portions 40*a'* and 40*b'* having centrally located mounting openings 42*a'* and 42*b'* and a plurality of projections 44*a'* and 44*b'* connected to their associated connecting portions and arranged to extend generally radially of their associated mounting openings with adjacent projections cooperating to bound essentially uniformly sized cutout areas 46*a'* and 46*b'*. Projections 44*a'* and 44*b'* are divided into a plurality of parallel fingers 48*a'* and 48*b'*, which have relatively inner ends 50*a'* and 50*b'* connected to their associated connecting portions 40*a'* and 40*b'* and relatively outer ends 52*a'* and 52*b'* preferably arranged to lie essentially along arcs of a circle whose center is coincident with the centers of their associated mounting openings 42*a'* and 42*b'*. Fingers 48*a'* and 48*b'* differ from fingers 48*a* and 48*b* of head 10 in that they are defined by skip-cutting projections 44*a'* and 44*b'* to provide parallel slits 62*a* and 62*b* and joined areas 64*a* and 64*b*. The specific skip-cut pattern is not critical, but it is preferable that slits are provided at outer ends 52*a'* and 52*b'* of all of fingers 48*a'* and 48*b'*, such that such outer ends are separable upon placement of head 10' in use. The purpose of this construction is to provide for an increase in unit pressure applied by fingers 48*a'* and 48*b'* to a workpiece over that afforded by the fingers of head 10', while still retaining improved operating characteristics over prior Star head 20. Thus, skip-cutting would be used, where it is desired to maximize the abrading capability of a head, while full-cutting or complete separation of fingers would be used, where it is desirable to maximize flexibility of a head to allow relatively light abrading action to be performed on sharply contoured surfaces.

Sheets 38*a'* and 38*b'* are preferably assembled by placing a spacer washer 66 adjacent non-abrasive surface 56' of sheet 38*b'* and then clamping the sheets and washer together by two or more metal staples 68. Washer 66 is preferably formed from a somewhat compressible material, such as paper or cardboard, whose thickness exceeds the individual thicknesses of sheets 38*a'* and 38*b'* and preferably approximates the combined thicknesses of such sheets. The outer diameter of washer 66 is shown as being slightly less than that of the connecting portion of sheets 38*a'* and 38*b'* and its inner diameter is shown as approximately corresponding to the diameters of mounting openings 42*a*′ and 42*b*′.

It is contemplated that heads 10′ would be used in pairs with their individual spacer washers removably arranged for face-to-face engagement, such that the abrasive surfaces of the heads face in opposite directions. When a pair of heads 10′ are mounted in this manner, their fingers are relatively unconstrained in a direction axially of their mounting openings in order to permit the fingers to better conform to a contoured work surface.

Figure 8:
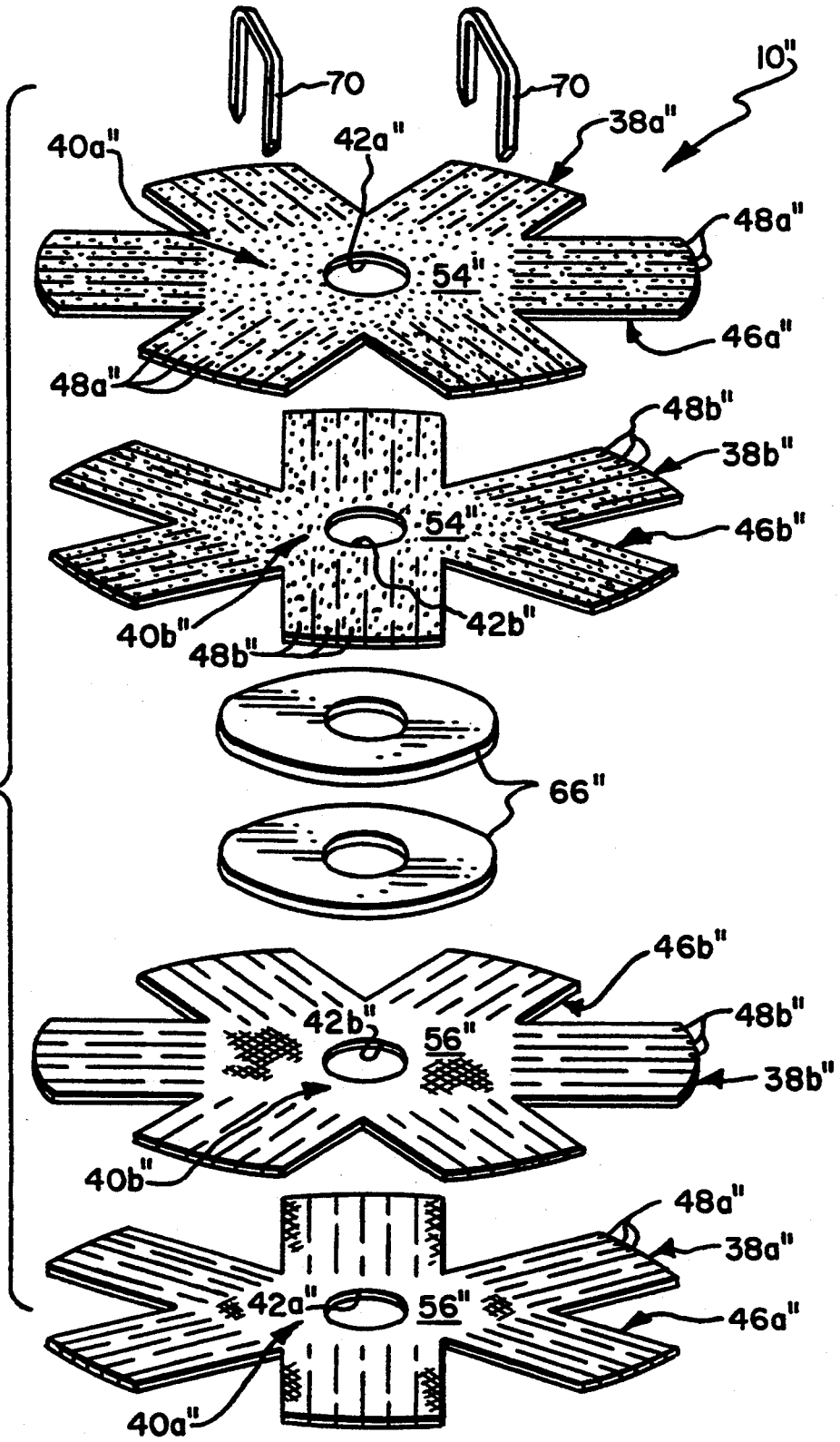
FIG. 8 is an exploded, perspective view of a further sanding/deburring head construction employing four abrasive sheets.

A further form of the invention is shown in FIG. 8, wherein a pair of heads 10′ of the type shown in FIGS. 6 and 7 are permanently fixed together to define a composite head 10″ by means of a single pair of staples 70. The elements of head 10″, which are common to heads 10′ are designated by like double primed numerals to facilitate understanding of this mode of construction In forming head 10′, a single spacer washer may be employed in place of two spacer washers shown in FIG. 8, and the thickness of such washers may be varied, as desired to control the openness of the head, i.e. the degree of flexing of fingers 48*a*″ and 48*b*″ normal to the planes of sheets 38*a*″ and 38*b*″.

Heads formed in accordance with the invention are not limited as to diameter and numbers of sheets, projections and fingers employed, except that each head must include a minimum of two sheets, each sheet must have a minimum of three projections and each projection must have a minimum of two fingers to provide a unit of even limited service. On the other hand, the maximum number of projections and the widths thereof employed in forming heads 10, 10′ and 10″ is preferably such that the cut-out areas have radial extents not substantially less than the length of the fingers. The maximum number of fingers into which the projections are divided is limited by the strength of the abrasive material and/or the type of sanding or deburring operation to be performed. As a general rule, the larger the number of fingers provided, the softer the feel of the head and the greater its ability to sand contoured surfaces without imparting scratches or sanding marks thereto.

By referring to FIG. 1, it will be understood that adjustable mounting assembly 16 allows for the removable mounting of one or more heads of the types described above for driven rotation by tool 14. For example, assembly 16 is shown as mounting the head 10″ of FIG. 8 and as including a mounting socket 80 formed with a stepped diameter axially, extending opening having a screw threaded end portion 80*a* and an enlarged diameter bore end portion 80*b*; a clamping screw 84 formed with a screw threaded end portion 84*a*, an enlarged diameter cylindrical or central bearing portion 84*b* and a clamping or head portion 84*c*; a pair of relatively thick, large diameter clamping washers 86, 86; and a plurality of relatively thin, small diameter spacer washers 88, 88. Threaded end portion 80*a* is sized to threadably receive clamping screw threaded end portion 84*a*; and bore end portion 70*b*, the through openings of washers 86 and 88, and the mounting openings of heads 10, 10′ and 10″ are sized to freely, slidably receive bearing portion 84*b* of clamping screw 84. The axial lengths of the individual elements comprising assembly 16 and that of heads 10, 10′ and 10″ are such that by employing varying numbers of spacer washers 88, one or more of such heads may be removably clamped for rotation with drive shaft 12 upon the threading of clamping screw 84 into socket 80. A desirable feature of the construction of heads 10′ and 10″ is that frictional engagement of the inner edges of their abrasive sheets and washers bounding their mounting openings with the surface of bearing portion 84*b* of clamping screw 84 tends to thread screw end portion 84*a* into threaded end portion 80*a* of socket 80 upon initiation of operation of tool 14 sufficiently to obviate the need for full manual tightening of the screw.

Figure 5:
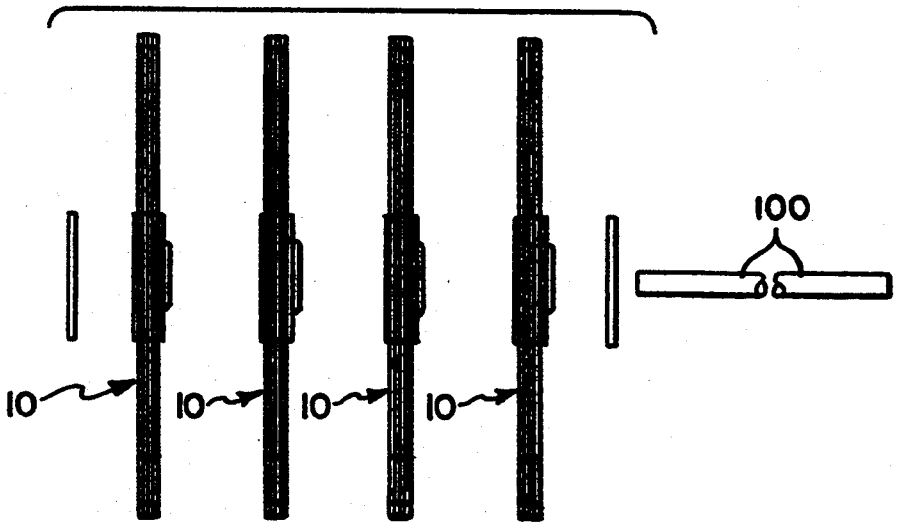
FIG. 5 is a view illustrating a further sanding/deburring head construction.

In FIG. 5 there is illustrated an alternative mounting arrangement, wherein a plurality of individual heads of the type shown for example in FIGS. 3 and 4 are intended to be permanently mounted in axial end to axial end abutting relationship on a common mounting or drive shaft 100 by means of a suitable adhesive to form a composite head of desired axial length, much in the same manner as discussed above with reference to a conventional Star head.

What is claimed is:

1. A flexible sanding/deburring head removably attachable to a power source for rotation about an axis, said head including a plurality of juxtaposed sheets of flexible abrasive material, each of said sheets being cut to define a connecting portion having a mounting opening disposed centrally thereof and at least three projections connected to said connecting portion to extend generally radially of said mounting opening, said projections being spaced annularly of said mounting opening and bounding essentially uniformly sized cut out areas, each of said projections including a plurality of generally parallel fingers having radially inner and outer ends, said inner ends are connected to said connecting portion, said projections of one of said sheets are aligned with said areas of a next adjacent one of said sheets, and said fingers of said projections are interconnected to each other between said inner and outer ends thereof by skip-cutting said projections.

2. A head according to claim 1, wherein said fingers of said projections are unconnected to each other adjacent said outer ends.

3. A head according to claim 2, wherein said fingers of said projections are unconnected to each other adjacent both of said inner and outer ends.

4. A head according to claim 1, wherein said sheets are fixed together by a washer overlying said connecting portion of one of said sheets inwardly of said inner ends of said fingers and staples extending through said washer and said sheets, and said washer has a mounting opening aligned with the mounting openings of said sheets.

5. A head according to claim 4, wherein said head has two of said sheets and one of said washers.

6. A head according to claim 5, wherein said sheets each include an abrasive surface and a relatively non-abrasive surface, said sheets are arranged to have the abrasive surfaces thereof face in a common direction, and said washer engages with said non-abrasive surface of said one of said sheets.

7. A head according to claim 6, wherein said fingers of said projections are unconnected to each other adjacent said outer ends.

8. A head according to claim 7, wherein the widths of said projections, as measured transversely of said fingers thereof are essentially equal to or greater than the widths of said areas as measured between adjacent projections at said outer ends of said fingers thereof.

9. A head according to claim 1, wherein said head includes four of said sheets, said sheets each include an abrasive surface and a relatively non-abrasive surface, said sheets are arranged in first and second pairs of adjacent sheets, wherein the abrasive surfaces of adjacent sheets of said first pair face in a direction away from the abrasive surfaces of adjacent sheets of said second pair, said pairs of sheets are separated from one another by at least one washer engaging with the non-abrasive surfaces thereof, and said washer having a mounting opening aligned with the mounting openings of said sheets.

10. A head according to claim 9, wherein said sheets and said washer are fixed in stacked relationship by staples extending therethrough.

11. A head according to claim 10, wherein said fingers of said projections are unconnected to each other adjacent said outer ends.

12. A head according to any one of claims 1, 2, 3, 4, 5, 6, 7, 8, 9, 10, or 11, in which said areas are cut out and open radially outwardly of the mounting openings of said sheets.

13. A flexible sanding/deburring head removably attachable to a power source for rotation about an axis, said head including a plurality of juxtaposed sheets of flexible abrasive material, each of said sheets being cut to define a connecting portion having a mounting opening disposed centrally thereof and at least three projections connected to said connecting portion to extend generally radially of said mounting opening, said projections being spaced annularly of said mounting opening and bounding essentially uniformly sized cut-out areas opening radially outwardly of said mounting opening, each of said projections including a plurality of generally parallel fingers having radially inner and outer ends, said inner ends are connected to said connecting portion, said projections of one of said sheets are aligned with said areas of a next adjacent one of said sheets, and said sheets are fixed together by at least one washer overlying said connecting portion of one of said sheets and staples extending through said washer and said sheets, and said washer has a mounting opening aligned with the mounting openings of said sheets.

14. A head according to claim 13, wherein said head includes two of said sheets, said sheets each include an abrasive surface and a relatively non-abrasive surface, said sheets are arranged with said abrasive surface of one of said sheets engaging with said non-abrasive surface of the other of said sheets, and said washer engages with said non-abrasive surface of said one of said sheets.

15. A head according to claim 13, wherein said head includes four of said sheets, said sheets each include an abrasive surface and a relatively non-abrasive surface, said sheets are arranged in first and second pairs of adjacent sheets, wherein the abrasive surfaces of adjacent sheets of said first pair face in a direction away from the abrasive surfaces of adjacent sheets of said second pair, and said washer is disposed intermediate said pairs of adjacent sheets.

16. A flexible sanding/deburring head removably attachable to a power source for rotation about an axis, said head including a plurality of juxtaposed sheets of flexible abrasive material, each of said sheets being cut to define a connecting portion having a mounting opening disposed centrally thereof and at least three projections connected to said connecting portion to extend generally radially of said mounting opening, said projections being uniformly spaced annularly of said mounting opening, each of said projections including a plurality of generally parallel fingers having radially inner and outer ends, said inner ends are connected to said connecting portion and said fingers of said projections are interconnected to each other between said inner and outer ends by skip-cutting said projections.

17. A head according to claim 16, wherein said projections are separated from adjacent ones of said projections by generally V-shaped cut-out areas opening radially outwardly of said mounting opening.

18. A head according to claim 17, wherein said sheets of an adjacent pair of said sheets have their projections and areas arranged in alignment.

19. A sheet of flexible abrasive material intended to be disposed in juxtaposition with at least one like sheet for use in forming a flexible sanding/deburring head intended to be removably attachable to a power source for rotation about an axis, said sheet being cut to define a connecting portion having a mounting opening disposed centrally thereof and at least three projections connected to said connecting portion to extend generally radially of said mounting opening, said projections being spaced annularly of said mounting opening, each of said projections including a plurality of generally parallel fingers having radially inner and outer ends, said inner ends are connected to said connecting portion and said fingers of said projections are interconnected to each other between said inner and outer ends by skip-cutting said projections.

20. A sheet according to claim 18, wherein said projections are separated from adjacent ones of said projections by cut-out areas opening radially outwardly of said mounting opening.

21. A sheet according to claim 19, wherein said sheet is formed with six of said projections and six of said areas.

22. A sheet according to claim 20, wherein said cut-out areas are generally V-shaped, and the widths of said projections, as measured transversely of said fingers thereof, are essentially equal to widths of said areas, as measured between adjacent projections at said outer ends of said fingers.

23. A flexible sanding/deburring head removably attachable to a power source for rotation about an axis, said head including a plurality of juxtaposed sheets of the type set forth in claim 19, wherein said sheets each include at least one abrasive surface, certain of said sheets each having said abrasive surface thereof arranged to face one direction aligned with said axis and others of said sheets each having said abrasive surface thereof arranged to face in an opposite direction aligned with said axis, and said projections of one of said certain of said sheets are aligned with said areas of a next adjacent one of said certain of said sheets, and said projections of one of said others of said sheets are aligned with said areas of a next adjacent one of said others of said sheets.

24. A head according to claim 23, wherein said projections of each of said sheets are separated from adjacent ones of said projections thereof by cut-out areas of generally V-shaped configuration and arranged to open radially outwardly of said mounting opening.

25. A head according to claim 24, wherein the widths of said projections, as measured transversely of said fingers thereof, are essentially equal to widths of said areas, as measured between adjacent projections at said outer ends of said fingers.

* * * * *